United States Patent [19]

Eisele

[11] 4,112,327

[45] Sep. 5, 1978

[54] CATHODE STRUCTURE AND METHOD

[75] Inventor: Franz X. Eisele, Oceanside, Calif.

[73] Assignee: Hughes Aircraft Company, Culver City, Calif.

[21] Appl. No.: 733,657

[22] Filed: Oct. 18, 1976

[51] Int. Cl.[2] ..... H01J 1/20; H01J 19/14

[52] U.S. Cl. ..... 313/337; 313/270; 313/346 R; 313/446

[58] Field of Search ..... 313/346 R, 446, 447, 313/451, 337, 270, 346

[56] References Cited

U.S. PATENT DOCUMENTS

| | | | |
|---|---|---|---|
| 2,431,137 | 11/1947 | O'Larte et al. | 313/451 |
| 3,311,774 | 3/1967 | Atti | 313/337 |
| 3,610,988 | 10/1971 | Schmitz | 313/414 |

*Primary Examiner*—Saxfield Chatmon, Jr.
*Attorney, Agent, or Firm*—Allen A. Dicke, Jr.; W. H. MacAllister

[57] ABSTRACT

Cathode cup has a stop shoulder therein. Cathode is spring urged against the stop shoulder so that it is retained in position through mechanical shock and thermal cycling. The method of assembling the cathode structure includes the step of compressing the spring loaded structure and staking the cathode cup behind the spring.

6 Claims, 2 Drawing Figures

CATHODE STRUCTURE AND METHOD

BACKGROUND

This invention is directed to a cathode structure and the method of making the cathode.

The emissive material of a cathode must be accurately retained in position so that the emitted electron stream is in a known position. With shifting of the cathode, the source of the electron stream is shifted to produce beam inaccuracy. Maintaining the cathode in position has not been adequately accomplished because temperature cycling causes loosening of rigidly mounted mechanical structures. Furthermore, mechanical vibrations and testing operations tend to loosen a rigidly mounted cathode structure. A cathode such as shown in Schmitz U.S. Pat. No. 3,610,988 is subject to such loosening, as a result of heat cycling in testing and in use, due to radio frequency heating as well as cathode heater heating.

A structure which is capable of resisting loosening due to thermal cycling and mechanical stresses is required in order to maintain the cathode in place in devices where an accurately located electron beam is required.

SUMMARY

In order to aid in the understanding of this invention, it can be stated in essentially summary form that it is directed to a cathode structure and a method for producing the cathode structure, the cathode structure comprising a cathode cup having a stop shoulder therein and a cathode spring urging the cathode against the stop shoulder so that it remains firmly in contact with the shoulder even through thermal cycling. The method comprises locating the cathode against its stop shoulder, compressing the spring against the cathode to urge it against the stop shoulder and fixing the compressed end of the spring.

It is thus an object of this invention to provide a cathode structure which is capable of withstanding thermal cycling without loosening. It is another object to provide a cathode structure which includes a cathode spring urged against a shoulder in the cathode structure to restrain the cathode in place through thermal cycling. It is another object to provide a cathode structure which comprises a cathode cup and a shoulder within the cathode cup with the cathode spring urged against the shoulder.

It is a further structure to employ a frusto-conical shaped spring washer to apply continuous internal compression forces in the cathode structure to take up mechanical and temperature cycling during cathode use to maintain the parts firmly in position, so that the cathode is continuously under stress.

It is another object of this invention to provide a method by which a cathode structure can be assembled which includes during the assembly process stressing a resilient member in the cathode structure and thereafter permanently assembling the cathode with the resilient member in the stressed condition so that stresses are maintained in the completed cathode structure assembly.

Other objects and advantages of this invention will become apparent from the study of the following portion of the specification, the claims and the attached drawings.

DESCRIPTION

Figure 1:
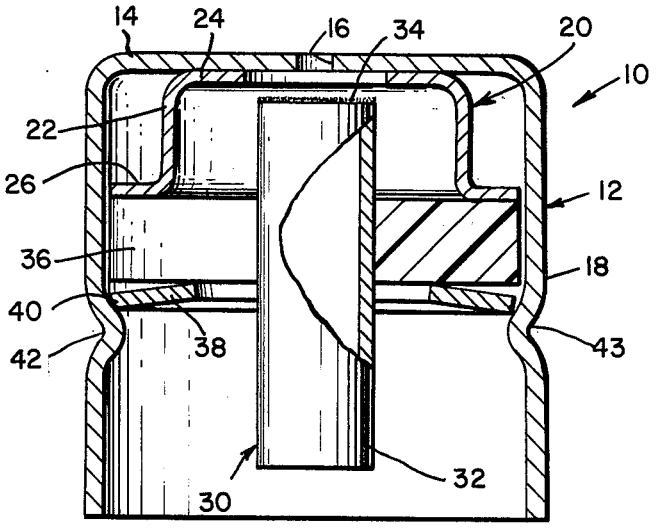
FIG. 1 is a longitudinal section taken generally along a diameter of the cathode structure of this invention, with some parts seen in elevation and some parts taken in section.
Figure 2:
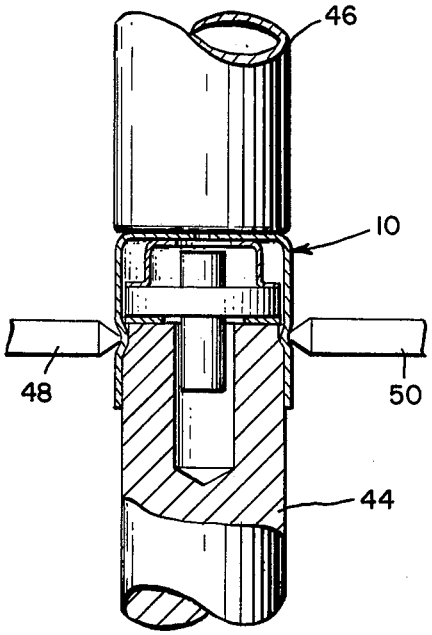
FIG. 2 is a sectional view taken generally along the longitudinal axis and on a diameter of the cathode structure, showing the assembly equipment by which the cathode assembly method is achieved.

The cathode assembly of this invention is generally indicated at 10 in FIGS. 1 and 2. The cathode assembly comprises cup 12 which has front wall 14 with beam opening 16 therein. Cup 12 also has sidewalls 18 which in the preferred embodiment are in the form of cylindrical tubular walls.

Cathode spacer 20 has a cylindrical central tubular wall 22 which carries on its forward end inwardly directed abutment flange 24. It carries at is rearward end outwardly directed stop flange 26. Stop flange 26 fits closely within cup side wall 18 but it is a sliding fit therein. When abutment flange 24 abuts against the inner surface of front wall 14 then stop flange 26 serves as a stop in fixed position within cup 12.

Cathode 30 comprises cathode tube 32 which is closed at its forward end and carries electron emissive material 34 on its front surface. Cathode tube 32 is arranged so that a heater may be inserted therein to cause emission from emissive material 34. Cathode 30 is connectable to a suitable source of potential. Cathode 30 is mounted on mounting disc 36 which is of insulative material so that the cathode cup may be at a different potential from the cathode. Mounting disc 36 lies against stop flange 26 so that emissive material 34 is precisely located with respect to beam opening 16.

Spring washer 38 is of non-planar frusto-conical shape, commonly called a Bellville spring. Spring washer 38 is oriented so that its surface adjacent its inner opening engages against mounting disc 36 while its outer edge 40 is adjacent the inner wall of cup sidewall 18 and is away from mounting disc 36. When the cathode assembly is compressed and spring washer 38 is stressed, cup sidewalls 18 are staked. Staking provides staking ridges or dimples such as 42 and 43 on which the outer edge 40 engages to act as a stop or an abutment for the outer edge of spring. When the spring is stressed, stress is applied to mounting disc 36 and through cathode spacer 20 back to cup 12 so that compressive stress is maintained through the portion of the cathode structure within the cup and tension is maintained in the cup. Changes in dimension due to temperature cycling are overcome by spring deflections so that no permanent deflections occur by thermal cycling. Thus, the stress which maintains the cathode in position with respect to beam opening 16 is continued and parts are not loosened by thermal or mechanical cycling.

FIG. 2 illustrates the mounting of the unstaked cathode assembly 10 on support mandrel 44. The cathode cup fits down over the outside of support mandrel 44 in a slip fit engagement. An internal bore in the punch receives cathode tube 32. The top face of the punch engages the lower outer surface of spring washer 38. Ram 46 is brought down against the top face of cup 12. It is brought down with sufficient force to resiliently deflect spring washer 38, in effect to thrust the lower outer corner 40 upward toward front wall 14 to apply spring force through mounting disc 36 and cathode spacer to the front wall of cathode cup 12. The press equipment is designed in such a manner to either provide the correct compressive stress or the correct compressive distance. The compression is held on the spring with spring deflection as staking knives, such as knives 48 and 50 are brought forward to impress the staking dimples or grooves or inwardly directed ridge shoulders into the cup sidewall to serve as stop abutments to engage under the outer edge 40 of the spring washer.

Thereupon the staking knives are released and then ram 46 is released so that cathode assembly can be removed from support mandrel 44. The internal construction of the cathode assembly is maintained in compression between the stop shoulder and the staking ridge shoulder so that the resilient deflected spring holds the internal parts of the assembly against these stop shoulders.

This invention having described as preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A cathode structure comprising;

a cathode cup having a side wall and having a front wall therein;

a stop in said cup spaced from said front wall;

a cathode comprised of an insulator disc and a cathode tube mounted on said insulator disc, said insulator disc being engaged against said stop;

a spring engaged against said cathode insulator disc, said spring having an inner edge and an outer edge and being non-planar in its non-deflected position, said spring having said inner edge engaged against said cathode insulator disc, said spring having said outer edge positioned substantially against said sidewall of said cup and away from said cathode insulator disc in its undeflected position, said outer edge of said spring engaging against an abutment within said cup and mounted on said cup, said abutment being positioned to hold said spring in its deflected position to force said cathode insulator disc against said stop in all conditions.

2. The cathode sructure of claim 1 wherein said abutment is a staking ridge in the sidewall of said cup.

3. The cathode structure of claim 1 wherein said spring is a Bellville spring.

4. The method of assembling a cathode structure comprising the steps of:

inserting a cathode into a cathode cup against a stop in the cathode cup;

engaging a bent spring washer against the cathode to resiliently urge the cathode against said stop;

resiliently deflecting the spring washer;

securing the spring washer with respect to the cathode cup with the spring washer in a deflected condition so that the spring resiliently urges the cathode against the stop in all conditions to firmly position the cathode within the cathode cup.

5. The method of claim 4 wherein the step of deflection is achieved by applying resilient deflecting force against the spring and against the cathode cup and holding the spring in deflected position during the securing step.

6. The method of claim 4 wherein the securing step comprises staking the cup walls behind the deflected spring so that when released the deflected spring engages on a staking ridge to resiliently hold the cathode assembly together.

* * * * *